US010744377B1

(12) United States Patent
Chuang et al.

(10) Patent No.: US 10,744,377 B1
(45) Date of Patent: Aug. 18, 2020

(54) CLUB HEAD CONDUCIVE TO ENHANCEMENT OF RESILIENCE

(71) Applicant: Chi-Shun Chuang, Taichung (TW)

(72) Inventors: Chi-Shun Chuang, Taichung (TW); Chung-Chao Wang, Taichung (TW)

(73) Assignee: Chi-Shun Chuang, Taichung (TW)

( * ) Notice: Subject to any disclaimer, the term of this patent is extended or adjusted under 35 U.S.C. 154(b) by 0 days.

(21) Appl. No.: 16/512,714

(22) Filed: Jul. 16, 2019

(30) Foreign Application Priority Data

May 2, 2019 (TW) ..... 108205413 U

(51) Int. Cl.
*A63B 53/04* (2015.01)

(52) U.S. Cl.
CPC ..... *A63B 53/04* (2013.01); *A63B 2053/0416* (2013.01)

(58) Field of Classification Search
USPC ..... 473/324–350
See application file for complete search history.

(56) References Cited

U.S. PATENT DOCUMENTS 5,509,660 A * 4/1996 Elmer ..... A63B 53/04 473/288
6,506,129 B2 * 1/2003 Chen ..... A63B 53/04 473/329
6,743,120 B1 * 6/2004 Chen ..... A63B 53/047 473/349
6,923,733 B2 * 8/2005 Chen ..... A63B 53/047 473/305
7,121,958 B2 * 10/2006 Cheng ..... A63B 53/047 473/345
7,258,628 B2 * 8/2007 Huang ..... A63B 53/0466 473/342
7,371,188 B2 * 5/2008 Chen ..... A63B 53/04 473/329
7,431,665 B2 * 10/2008 Sugimoto ..... A63B 53/047 473/342
7,491,136 B2 * 2/2009 Deng ..... A63B 53/047 473/349
7,549,933 B2 * 6/2009 Kumamoto ..... A63B 53/0466 473/329
7,575,525 B2 * 8/2009 Matsunaga ..... A63B 53/0466 473/342

(Continued)

FOREIGN PATENT DOCUMENTS

JP 03097474 A * 4/1991 ..... A63B 53/04
JP 05212139 A * 8/1993

(Continued)

*Primary Examiner* — Alvin A Hunter
(74) *Attorney, Agent, or Firm* — Muncy, Geissler, Olds & Lowe, P.C.

(57) ABSTRACT

A club head conducive to enhancement of resilience includes a body and a panel. The body has a first front side and a first rear side. The panel is disposed on the first front side of the body. The panel has a second top edge, a second bottom edge, a second front side and a second rear side. The second front side is a ball-hitting surface. The second bottom edge extends toward the second rear side to form a wall portion. The wall portion partially sinks to a depth for defining a bending section facing the upper edge. As soon as the panel hits a ball, the bending section deforms and thereby generates bounce resilience.

18 Claims, 8 Drawing Sheets

(56) References Cited

U.S. PATENT DOCUMENTS 7,662,051 B2 * 2/2010 Chen ..... A63B 53/047 473/342
8,133,129 B2 * 3/2012 Boyd ..... A63B 53/047 473/288
8,398,506 B2 * 3/2013 Stites ..... A63B 53/0466 473/345
8,475,293 B2 * 7/2013 Morin ..... A63B 53/047 473/329
8,721,471 B2 * 5/2014 Albertsen ..... A63B 53/04 473/328
8,858,364 B2 * 10/2014 Deng ..... A63B 53/047 473/350
8,920,259 B2 * 12/2014 Takechi ..... A63B 53/047 473/329
8,926,450 B2 * 1/2015 Takahashi ..... A63B 53/0466 473/347
8,968,114 B2 * 3/2015 Boyd ..... A63B 53/047 473/324
8,979,674 B2 * 3/2015 Oldknow ..... A63B 53/047 473/350
9,033,818 B2 * 5/2015 Myrhum ..... A63B 53/0466 473/329
9,199,144 B2 * 12/2015 Mendoza ..... A63B 53/0475
2001/0055996 A1 * 12/2001 Iwata ..... A63B 53/04 473/350
2006/0135285 A1 * 6/2006 Hou ..... A63B 53/047 473/342
2013/0196785 A1 * 8/2013 Takechi ..... A63B 53/0466 473/332

FOREIGN PATENT DOCUMENTS

JP 08141117 A * 6/1996
JP 09253246 A * 9/1997
JP 2002052099 A * 2/2002
JP 2002085601 A * 3/2002
JP 2003210622 A * 7/2003
JP 2003265652 A * 9/2003 ..... A63B 53/047
JP 2003265656 A * 9/2003
JP 2003325710 A * 11/2003
JP 2003334267 A * 11/2003
JP 2004215724 A * 8/2004
JP 2006325748 A * 12/2006
JP 2008079979 A * 4/2008
JP 2008080095 A * 4/2008
JP 2008246085 A * 10/2008
JP 2016087008 A * 5/2016
JP 2018110844 A * 7/2018 ..... A63B 60/52
WO WO-9113658 A1 * 9/1991 ..... A63B 53/047

* cited by examiner

CLUB HEAD CONDUCIVE TO ENHANCEMENT OF RESILIENCE

BACKGROUND OF THE INVENTION

1. Technical Field

The present disclosure relates to golf clubs and, more particularly, to a club head conducive to enhancement of ball-hitting resilience.

2. Description of Related Art

A conventional golf club is typically composed of a shaft and a club head. The club head is mainly composed of a body 1 and a panel 2, as shown in FIG. 1. From a structural perspective of commercially-available club heads, their panels are generally of two types: plate-shaped panels and cup-shaped panels. Referring to FIG. 1, the edge of the plate-shaped panel is coupled to the body and thus fixed thereto. The cup-shaped panel has the same edge as the plate-shaped panel. The edge of the cup-shaped panel extends to form an annular wall portion which surrounds the panel. The annular wall portion is coupled to the body. The plate-shaped panels and the cup-shaped panels each have a drawback, that is, providing additional bounce resilience during a ball-hitting process by deformation of the panel itself.

BRIEF SUMMARY OF THE INVENTION

It is an objective of the present disclosure to provide a club head conducive to enhancement of ball-hitting resilience of ball-hitting surface In order to achieve the above and other objectives, the present disclosure provides a club head conducive to enhancement of resilience, comprising a body and a panel. The body has a first front side and a first rear side. The panel is disposed on the first front side of the body. The panel has a second top edge, a second bottom edge, a second front side and a second rear side. The second front side is a ball-hitting surface. The second bottom edge extends toward the second rear side to form a wall portion. The wall portion partially sinks to a depth for defining a bending section facing the upper edge. As soon as the panel hits a ball, the bending section deforms and thereby generates bounce resilience.

DETAILED DESCRIPTION OF THE INVENTION

Figure 1:
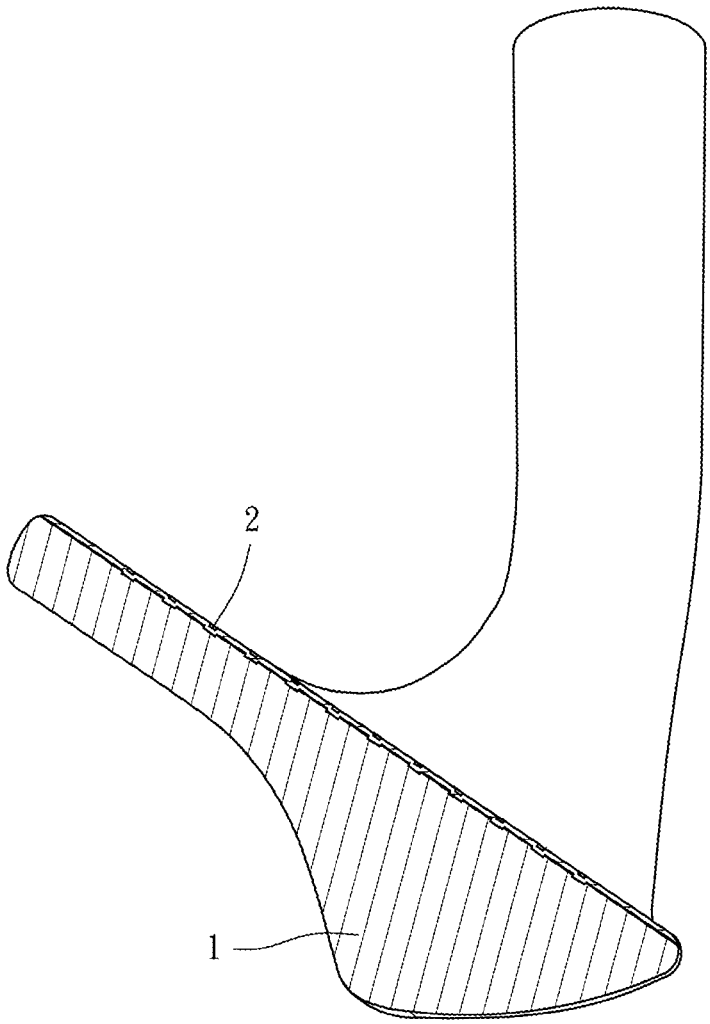
FIG. 1 (PRIOR ART) is a schematic view of a conventional club head.
Figure 2:
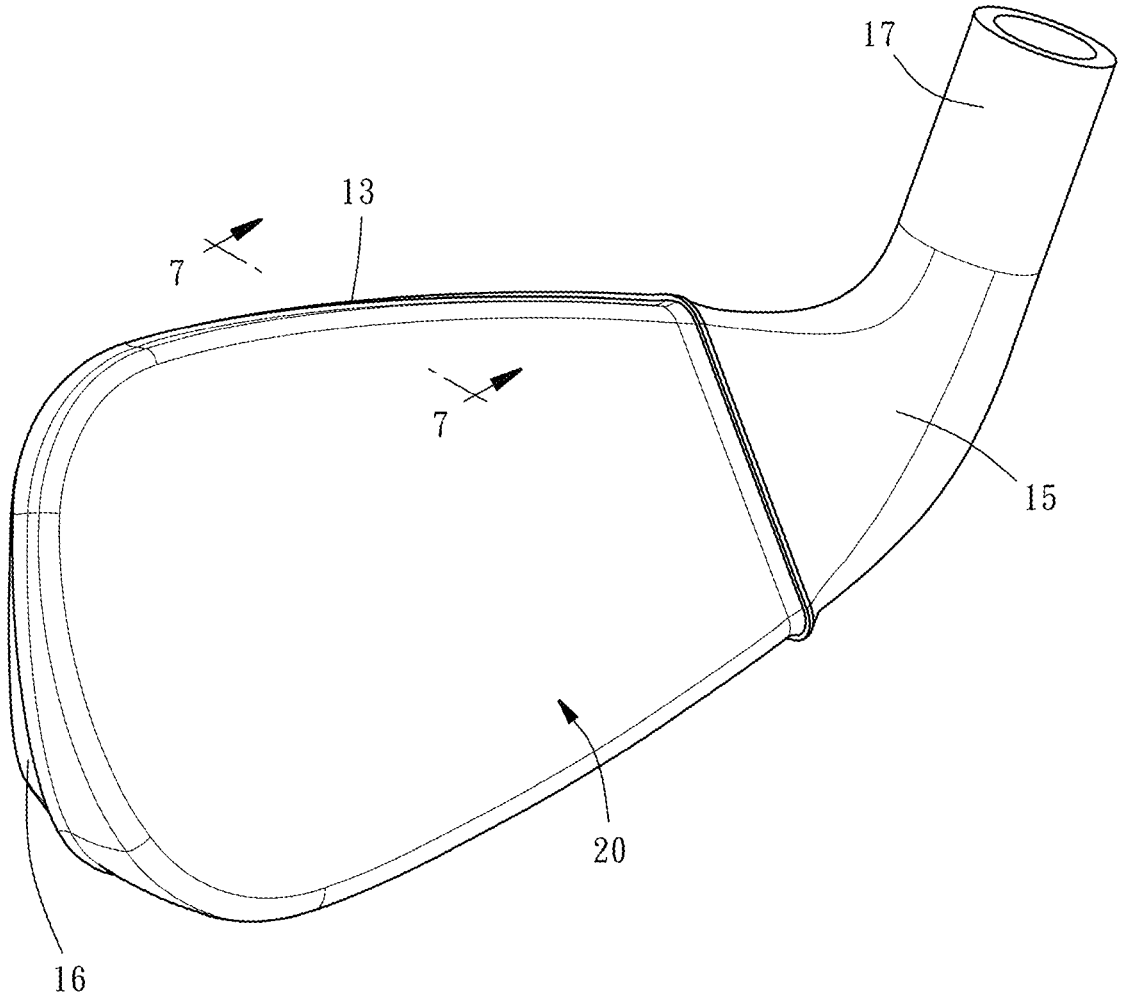
FIG. 2 is a perspective view of a club head according to the first embodiment of the present disclosure.
Figure 3:
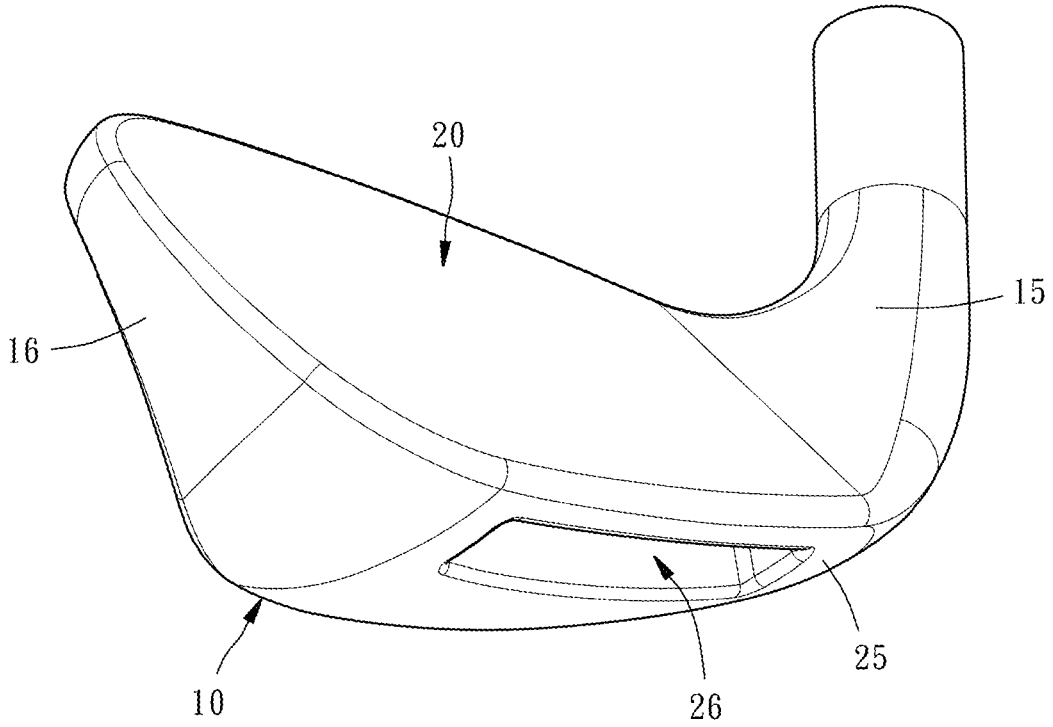
FIG. 3 is a perspective view of the club head from another angle according to the first embodiment of the present disclosure.
Figure 4:
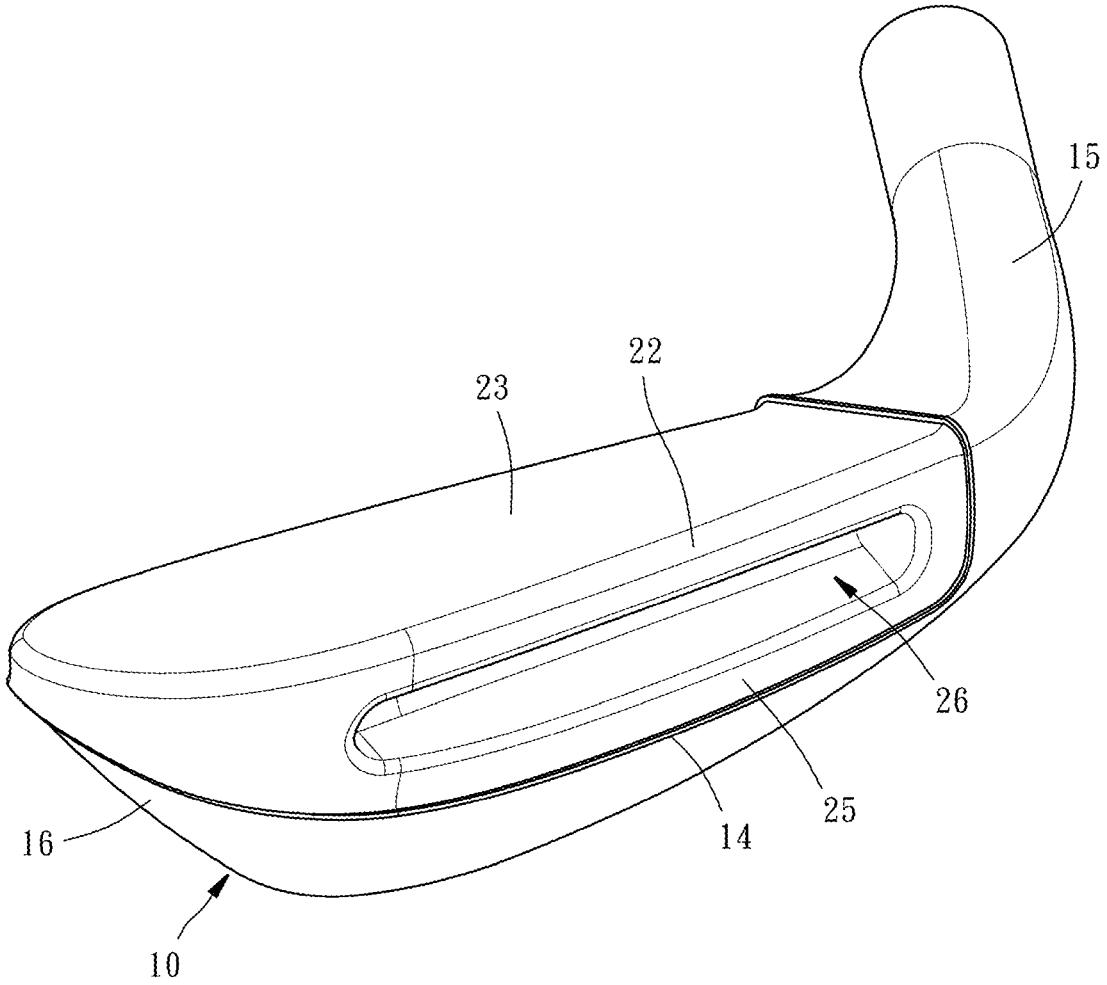
FIG. 4 is a perspective view of the club head from another angle according to the first embodiment of the present disclosure.
Figure 5:
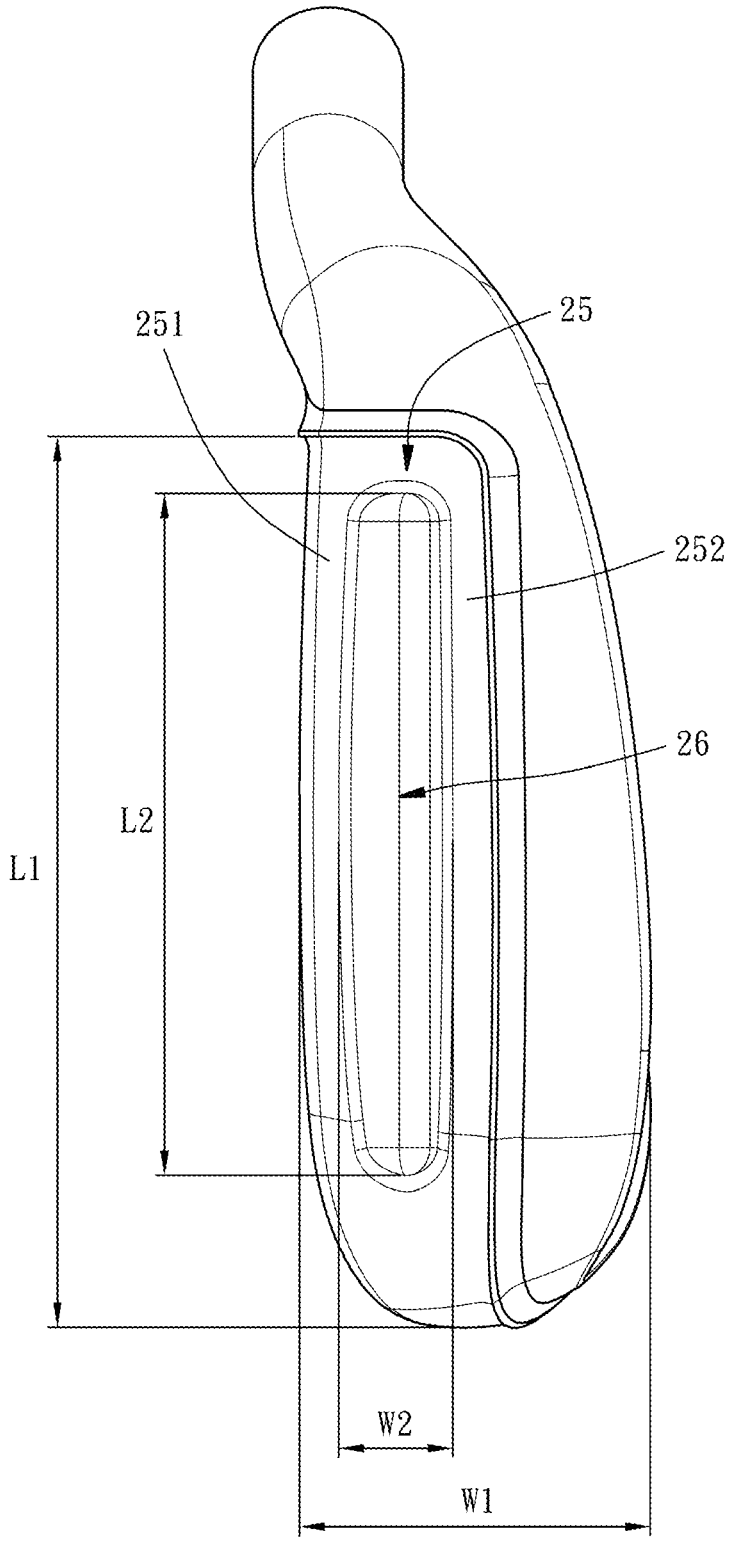
FIG. 5 is a bottom view of the club head according to the first embodiment of the present disclosure.
Figure 6:
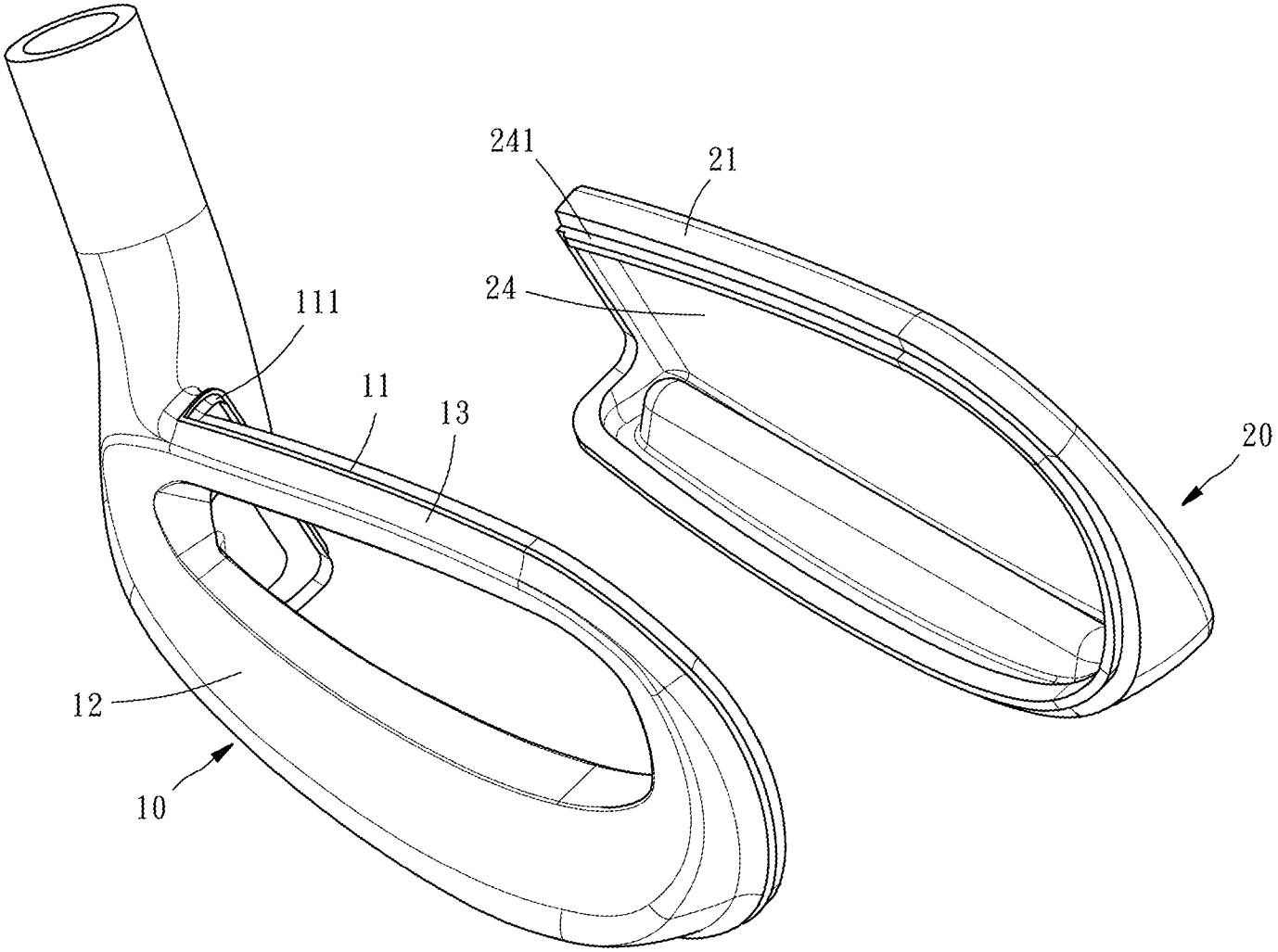
FIG. 6 is an exploded view of the club head according to the first embodiment of the present disclosure.

The technical features of the present disclosure, as disclosed herein, are not restrictive of any specific structures, purposes and applications described herein. All terms used herein are illustrative, descriptive terms comprehensible to persons skilled in the art. Direction-related terms, such as "front", "upper", "downward", "rear", "left", "right", "top", "bottom", "inside" and "outside", used herein are illustrative, descriptive terms are based on typical directions rather than terms restrictive of the claims of the present disclosure.

Singular determiners, such as "a", "an", "one" and "the", as used in the claims of the present disclosure, are also deemed to be plural determiners. Therefore, the expression "a component" may also mean "one or more components" and any equivalents well known among persons skilled in the art. All conjunctions used under similar circumstances must be interpreted as broadly as possible. Specific shapes, structural features and/or technical terms, as used herein, must be interpreted in a manner to include all equivalent, alternative structures and/or technologies capable of achieving the functions of the specific structural features and/or technical terms.

Referring to FIG. 2 through FIG. 7, a club head conducive to enhancement of resilience according to the first embodiment of the present disclosure comprises a body 10 and a panel 20.

The body 10 has a first front side 11, a first rear side 12, a first top edge 13 and a first bottom edge 14. A heel portion 15 and a toe portion 16 are disposed at two opposing ends of the body 10, respectively. The heel portion 15 has a neck portion 17 connected to a shaft (not shown). The first front side 11 has an annular groove 111.

Figure 7:
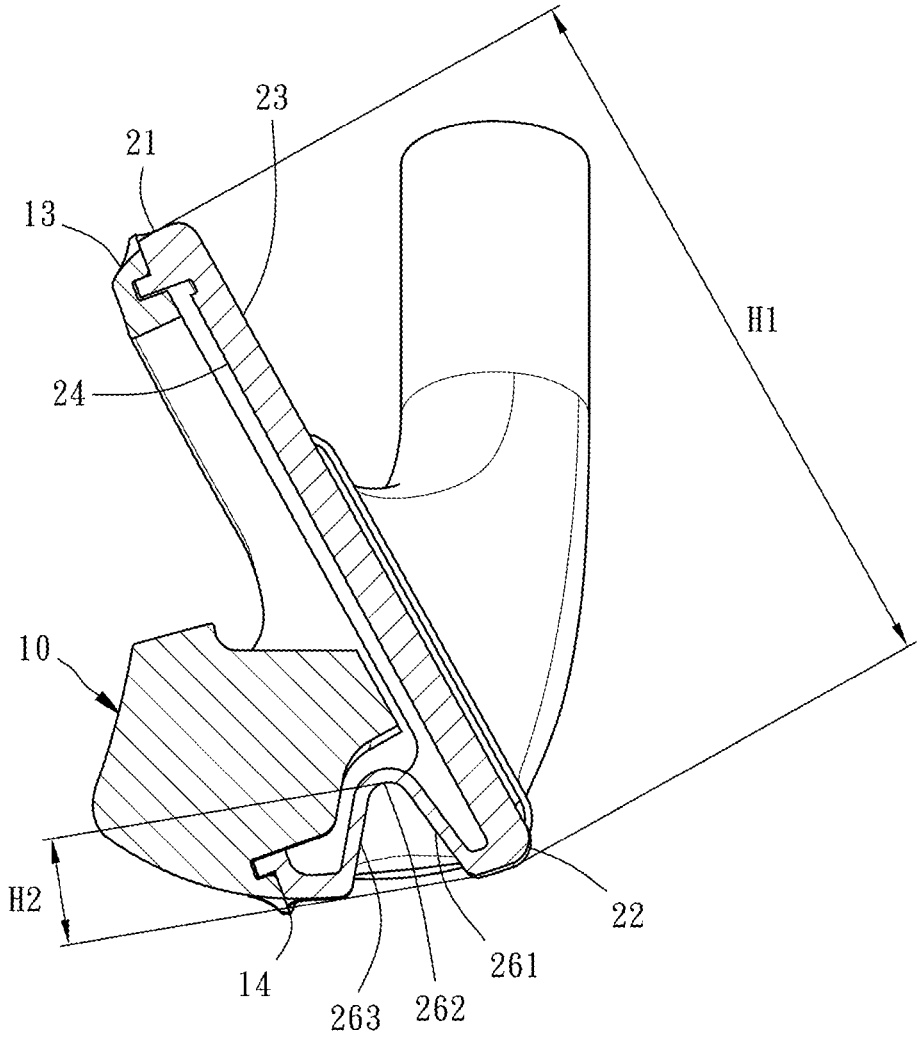
FIG. 7 is a cross-sectional view of the club head taken along line 7-7 of FIG. 2 according to the present disclosure.

The panel 20 is disposed on the front side 11 of the body 10 and corresponds in shape to the body 10. The panel 20 has a second top edge 21, a second bottom edge 22, a second front side 23 and a second rear side 24. The second rear side 24 has an annular rib 241. The second front side 23 is a ball-hitting surface. The second bottom edge 22 integrally extends toward the second rear side 24 to form a wall portion 25. Part of the wall portion 25 sinks to a depth for defining a bending section 26 facing the upper edge such that the wall portion 25 is divided, from the starting point of the extension to the end point thereof, into three sections, namely a first transverse section 251, the bending section 26 and a second transverse section 252. The bending section 26 comprises a leading leg segment 261, a vertex segment 262 and a trailing leg segment 263, so as to be capable of deforming and thereby generating bounce resilience. Therefore, the bending section 26 is arcuate or V-shaped, as shown in FIG. 7. The annular rib 241 of the panel 20 engages with the annular groove 111 of the body 10, by gluing, welding or screwing, such that the panel 20 is disposed on the first front side 11 of the body 10.

As soon as the panel 20 hits a ball, the bending section 26 formed from the wall portion 25 deforms and thereby generates bounce resilience. The bounce resilience generated by the bending section 26, together with resilience generated because of deformation of the second front side 23 when the panel 20 hits a ball, augments the ball-hitting force and ball-hitting distance achieved by the club head. The bending section 26 can generate the bounce resilience, provided that the bending section 26 has a predetermined length and width. In this embodiment, the length L2 of the bending section 26 is ⅛~1 time the length L1 of the panel 20, and the length L1 of the panel 20 is equal to the maximum distance between the left end of the panel 20 and the right end of the panel 20. In this embodiment, the width W2 of the bending section 26 is ½~⅝ time the width W1 of the bottom of the club head, and the width W1 of the bottom of the club head is equal to the maximum distance between the second bottom edge 22 of the panel 20 and the first bottom edge 14 of the body 10. In this embodiment, the depth H2 defining the bending section 26 is equal to 5/100~30/100 time the maximum distance H1 between the second top edge 21 and the second bottom edge 22.

Figure 8:
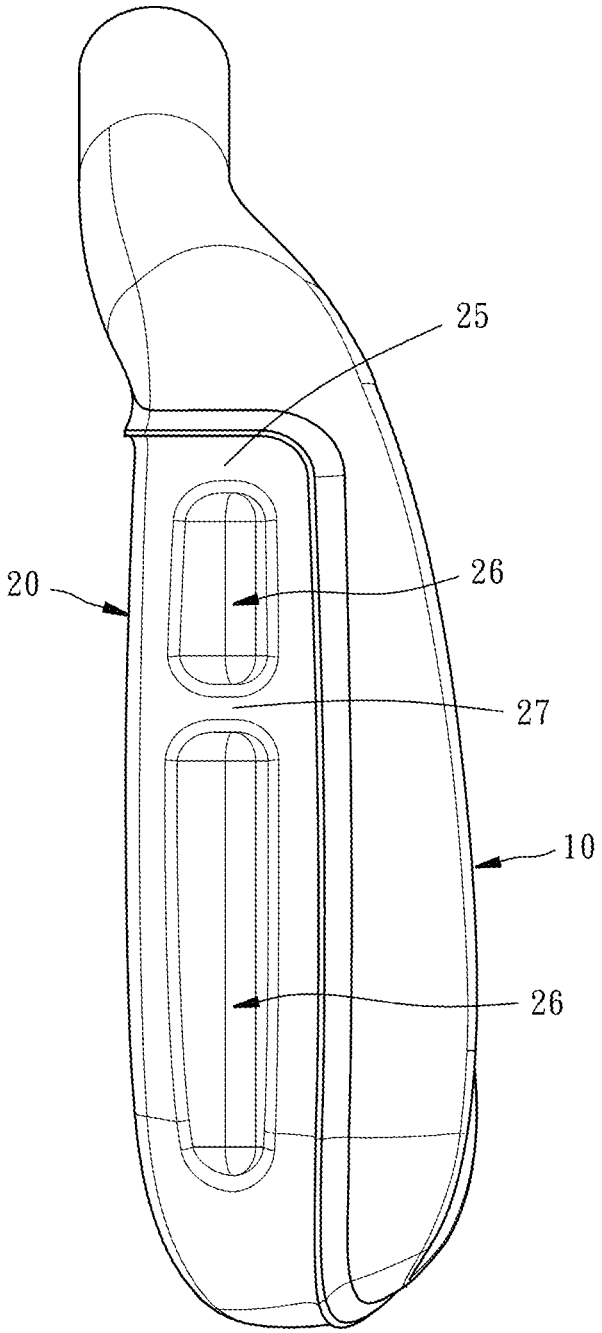
FIG. 8 is a bottom view of the club head according to the second embodiment of the present disclosure.

Although the bending section 26 in the first embodiment is in the number of one, the bending section 26 in the second embodiment is in the number of two. Referring to FIG. 8, in the second embodiment of the present disclosure, the club head conducive to enhancement of resilience comprises a body 10 and a panel 20. Two bending sections 26 are formed discretely from the wall portion 25 and aligned along the long axis of the panel 20. A discrete segment 27 is disposed between the two bending sections 26 and adapted to provide weak bounce resilience. Therefore, the position and width of the discrete segment 27 can be changed in order to change the ball-hitting force of the panel, thereby adjusting the ball-hitting distance and ball-hitting direction of the club head.

In the second embodiment of the present disclosure, the total length of the two bending sections is ⅛~9/10 time the length L1 of the panel, and the length L1 of the panel is equal to the maximum distance between the left end of the panel and the right end of the panel. The two bending sections are of equal or unequal length. In the second embodiment of the present disclosure, the width of the two bending sections is ½~⅛ time the width W1 of the bottom of the club head, and the width W1 of the bottom of the club head is equal to the maximum distance between the first bottom edge 22 and the second bottom edge 14. The two bending sections are of equal or unequal width.

What is claimed is:

1. A club head conducive to enhancement of resilience, comprising:

a body having a first front side, a first rear side, a first top edge and a first bottom edge, wherein a heel portion and a toe portion are disposed at two opposing ends of the body, respectively; and a panel disposed on the first front side of the body, corresponding in shape to the body, and having a second top edge, a second bottom edge, a second front side and a second rear side, the second front side being a ball-hitting surface, the second bottom edge extending toward the second rear side to form a wall portion, the wall portion partially sinking to a depth for defining a bending section, wherein, as soon as the panel hits a ball, the bending section deforms and thereby generates bounce resilience;

wherein a width of the bending section is ½~⅛ time a width of a bottom of the club head, and the width of the bottom of the club head is equal to a maximum distance between the second bottom edge and the first bottom edge.

2. The club head conducive to enhancement of resilience according to claim 1, wherein the bending section comprises a leading leg segment, a vertex segment and a trailing leg segment, so as to be capable of deforming and thereby generating bounce resilience.

3. The club head conducive to enhancement of resilience according to claim 2, wherein the wall portion is divided, from a start point of the extension to an end point thereof, into three sections, namely a first transverse section, the bending section and a second transverse section.

4. The club head conducive to enhancement of resilience according to claim 3, wherein the bending section is arcuate.

5. The club head conducive to enhancement of resilience according to claim 3, wherein the bending section is V-shaped.

6. The club head conducive to enhancement of resilience according to claim 1, wherein a length of the bending section is ⅛~1 time a length of the panel, and the length of the panel is equal to a maximum distance between a left end of the panel and a right end of the panel.

7. The club head conducive to enhancement of resilience according to claim 1, wherein the depth defining the bending section is equal to 5/100 ~30/100 time a maximum distance between the second top edge and the second bottom edge.

8. The club head conducive to enhancement of resilience according to claim 1, wherein the wall portion has two said bending sections.

9. The club head conducive to enhancement of resilience according to claim 8, wherein a total length of the two bending sections is ⅛~1 time a length of the panel.

10. A club head conducive to enhancement of resilience, comprising:

a body having a first front side, a first rear side, a first top edge and a first bottom edge, wherein a heel portion and a toe portion are disposed at two opposing ends of the body, respectively; and a panel disposed on the first front side of the body, corresponding in shape to the body, and having a second top edge, a second bottom edge, a second front side and a second rear side, the second front side being a ball-hitting surface, the second bottom edge extending toward the second rear side to form a wall portion, the wall portion partially sinking to a depth for defining a bending section, wherein, as soon as the panel hits a ball, the bending section deforms and thereby generates bounce resilience;

wherein the depth defining the bending section is equal to 5/100 ~30/100 time a maximum distance between the second top edge and the second bottom edge.

11. The club head conducive to enhancement of resilience according to claim 10, wherein the bending section comprises a leading leg segment, a vertex segment and a trailing leg segment, so as to be capable of deforming and thereby generating bounce resilience.

12. The club head conducive to enhancement of resilience according to claim 11, wherein the wall portion is divided, from a start point of the extension to an end point thereof, into three sections, namely a first transverse section, the bending section and a second transverse section.

13. The club head conducive to enhancement of resilience according to claim 12, wherein the bending section is arcuate.

14. The club head conducive to enhancement of resilience according to claim 12, wherein the bending section is V-shaped.

15. The club head conducive to enhancement of resilience according to claim 10, wherein a length of the bending section is ⅛~1 time a length of the panel, and the length of the panel is equal to a maximum distance between a left end of the panel and a right end of the panel.

16. The club head conducive to enhancement of resilience according to claim 10, wherein a width of the bending section is ½~⅛ time a width of a bottom of the club head, and the width of the bottom of the club head is equal to a maximum distance between the second bottom edge and the first bottom edge.

17. The club head conducive to enhancement of resilience according to claim 10, wherein the wall portion has two said bending sections.

18. The club head conducive to enhancement of resilience according to claim 17, wherein a total length of the two bending sections is ⅛~1 time a length of the panel.

* * * * *